US008485797B2

(12) United States Patent
Martinez et al.

(10) Patent No.: US 8,485,797 B2
(45) Date of Patent: Jul. 16, 2013

(54) EXTERNAL OIL EXPANSION CHAMBER FOR SEABED BOOSTING ESP EQUIPMENT

(75) Inventors: Ignacio Martinez, Rio de Janeiro (BR); Dan A. Merrill, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 374 days.

(21) Appl. No.: 12/825,182

(22) Filed: Jun. 28, 2010

(65) Prior Publication Data

US 2010/0329893 A1 Dec. 30, 2010

Related U.S. Application Data

(60) Provisional application No. 61/221,460, filed on Jun. 29, 2009.

(51) Int. Cl.
*F04B 35/04* (2006.01)
*H02K 5/10* (2006.01)
*H02K 5/132* (2006.01)

(52) U.S. Cl.
USPC ..... 417/414; 417/423.3; 417/423.7; 310/87

(58) Field of Classification Search
USPC ..... 417/53, 414, 423.3, 423.11, 423.14, 417/423.8, 540, 423.7, 424.1, 424.2; 166/66.4, 166/68.5, 105, 335–368; 310/87, 52–59
See application file for complete search history.

(56) References Cited

U.S. PATENT DOCUMENTS

| | | | | |
|---|---|---|---|---|
| 1,610,726 | A | 12/1926 | Arutunoff | |
| 2,423,825 | A * | 7/1947 | Blom | 417/414 |
| 2,545,422 | A * | 3/1951 | Blom | 417/414 |
| 6,059,539 | A * | 5/2000 | Nyilas et al. | 417/228 |
| 6,126,416 | A * | 10/2000 | Lee | 417/423.3 |
| 6,201,327 | B1 * | 3/2001 | Rivas | 310/87 |
| 6,268,672 | B1 * | 7/2001 | Straub et al. | 310/87 |
| 6,666,664 | B2 * | 12/2003 | Gross | 417/423.3 |
| 6,863,124 | B2 * | 3/2005 | Araux et al. | 166/66.4 |
| 7,217,107 | B2 * | 5/2007 | Du et al. | 417/414 |
| 2002/0192090 | A1 * | 12/2002 | Du et al. | 417/423.11 |
| 2004/0146415 | A1 * | 7/2004 | Merrill et al. | 417/414 |
| 2005/0008514 | A1 * | 1/2005 | Merrill et al. | 417/472 |

* cited by examiner

*Primary Examiner* — Devon Kramer
*Assistant Examiner* — Bryan Lettman
(74) *Attorney, Agent, or Firm* — Bracewell & Giuliani LLP

(57) ABSTRACT

An expansion chamber to serve ESP equipment installed on the seabed located in either a caisson or a conduit on a skid. The expansion chamber provides an external reservoir for expansion and contraction of motor oil in the ESP equipment. During operation of an ESP, the heat generated in the motor raises the temperature of the motor oil, causing it to expand. The expansion chamber is connected to the ESP equipment via oil lines that allow oil to expand into the expansion chamber when the temperature of the motor oil increases. The expansion chamber has a movable barrier therein that defines primary and secondary chamber. Oil communicates with the primary chamber. Formation fluid within the conduit surrounding the motor communicates with the secondary chamber.

19 Claims, 7 Drawing Sheets

Fig. 3
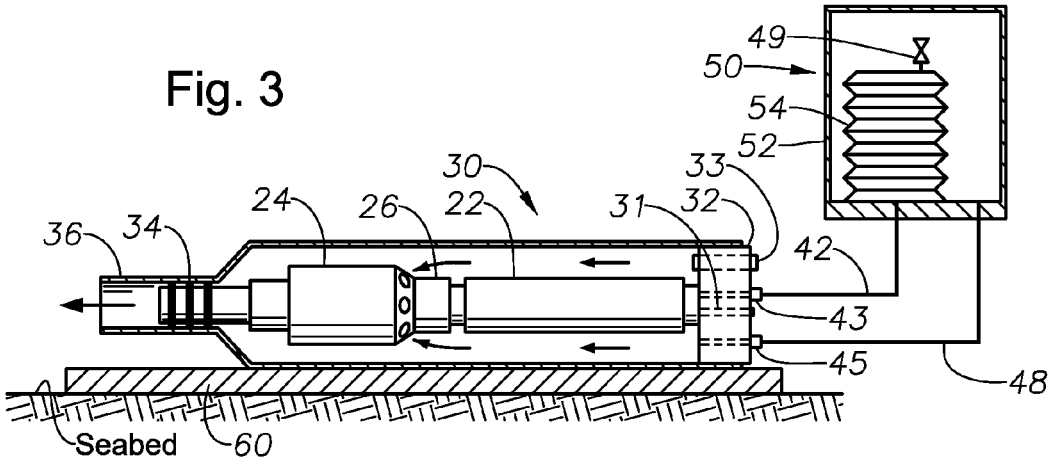
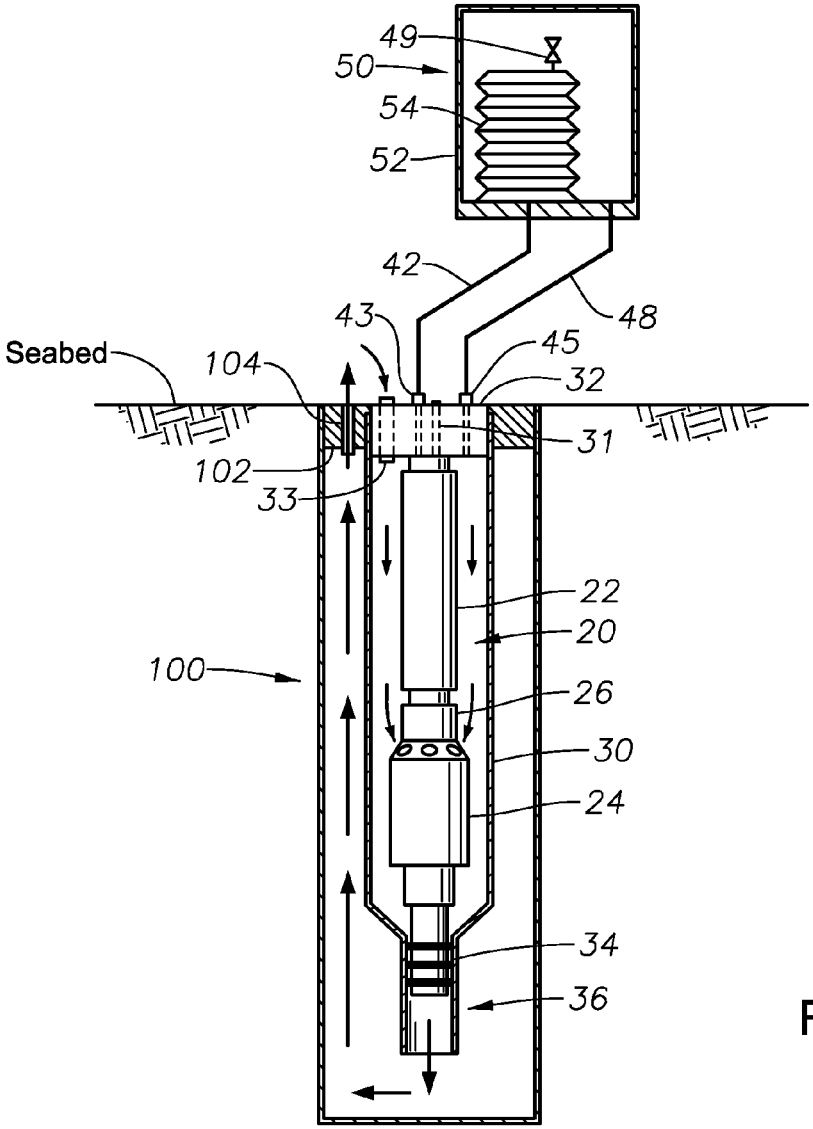
Fig. 4

EXTERNAL OIL EXPANSION CHAMBER FOR SEABED BOOSTING ESP EQUIPMENT

CROSS-REFERENCE TO RELATED APPLICATION

This application claims priority to provisional application 61/221,460, filed Jun. 29, 2009.

FIELD OF THE INVENTION

This invention relates in general to booster pump electric motors, and in particular to accommodating the expansion and contraction of dielectric lubricant of a sea floor submersible electric pump motor via a subsea expansion chamber.

BACKGROUND OF THE INVENTION

Electrical submersible pumps ("ESP") are used for pumping high volumes of well fluid, particularly in wells requiring artificial lift. The ESP typically has at least one electrical motor that normally is a three-phase, AC motor. The motor drives a centrifugal pump that may contain a plurality of stages, each stage comprising an impeller and a diffuser that increases the pressure of the well fluid. The motor is filled with a dielectric lubricant or oil that provides lubrication and aids in the removal of heat from the motor during operation of the ESP. A seal section is typically located between the pump and the motor for equalizing the pressure of the lubricant contained within the motor with the hydrostatic pressure of the well fluid on the exterior. The seal section is filled with oil that communicates with the oil in the motor.

The ESP is typically run within the well with a workover rig. The ESP is run on the lower end of a string of production tubing. Once in place, the ESP may be energized to begin producing well fluid that is discharged into the production string for pumping to the surface.

During operation, the temperature of the oil in the motor of the ESP increases due to friction in the motor, causing the volume of the oil to also expand. The oil is vital to maintaining the motor within its rated temperature and maintain reliability. However, oil may migrate outside of the motor when it expands, resulting in less oil for protecting the motor and possible contamination of other parts of the ESP.

To counteract the expansion of the oil, a bladder, bellows or labyrinth seals form an expansion chamber within a seal section of the ESP. The internal expansion chamber provides additional volume into which the oil can expand. However, this requires increasing the length of the ESP system, which can be a problem for a sea floor booster pump. In addition, the internal expansion chamber may fail and the entire ESP system would need to be replaced. This could result in costly downtime.

A technique is desired to allow for expansion of the motor oil surrounding the motor that may translate to extended life and increased reliability of the motor without increased ESP length.

SUMMARY OF THE INVENTION

In the present disclosure, an ESP is described that is part of a boosting system located on the seabed. The ESP may be horizontally mounted, inclined, or vertically mounted on a skid or within a caisson in the seafloor. The ESP has at least one motor and at least one pump, with a seal section located in between.

An expansion chamber comprising a primary chamber and a secondary chamber that is located external to the ESP boosting system in a. vicinity of a the sea floor has an oil port and a formation fluid port. An oil line connects to the oil port of the expansion chamber to thereby communicate with the primary chamber and communicate with the motor. A formation fluid line connects to the formation fluid port of the expansion chamber to thereby communicate with the secondary chamber and communicate with a capsule housing the motor. As the motor oil heats up and expands during operation, the motor oil flow into the primary chamber. The primary chamber expands to equalize the pressure between the motor oil and formation fluid. Further, the primary chamber may contract when the motor oil cools down. To achieve this expansion and contraction, the primary chamber may be fabricated as metallic bellows or an elastomeric bag.

The external expansion chamber arrangement thus provides an effective mechanism for dealing with expanding motor oil without the need of a longer ESP. Leaks due to expanding motor oil decrease and thereby loss of motor oil decreases as does contamination of the motor oil with formation fluid. Thus, the motor life is advantageously extended and its reliability is advantageously increased.

BRIEF DESCRIPTION OF THE DRAWINGS

FIG. 3 is a sectional view of an alternative embodiment of the embodiment of FIG. 1 mounted on a skid.

FIG. 4 is a sectional view of an electrical submersible pump within a caisson, in accordance with an embodiment of the invention.

DETAILED DESCRIPTION OF THE INVENTION

Figure 1:
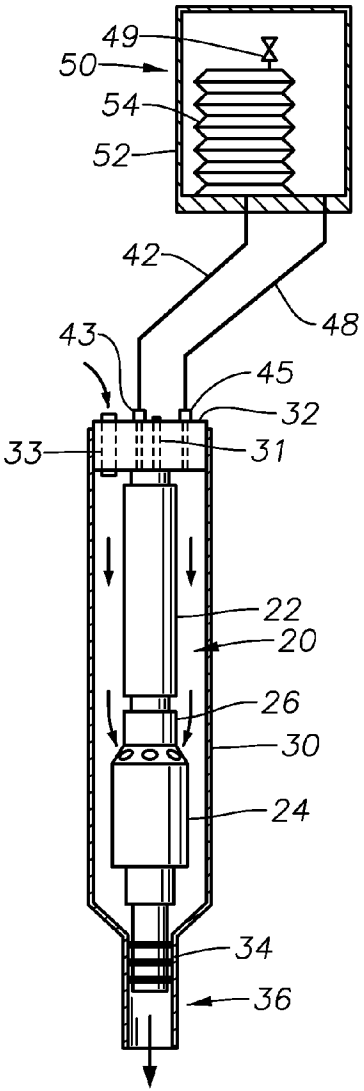
FIG. 1 is a sectional view of an electrical submersible pump with an expansion chamber, in accordance with an embodiment of the invention.

Referring to FIG. 1, an electrical submersible pump ("ESP") 20 is illustrated in a sectional view. The ESP 20 can be part of a boosting system located on the seabed. It may be horizontally mounted, inclined, or vertically mounted with a caisson in the seafloor, also referred to as a "dummy well." A motor 22 and pump 24 are shown with a seal section 26 located in between. The seal section 26 contains a thrust bearing and can contain a pressure equalizer to equalize the pressure of lubricant in the motor 22 with the hydrostatic pressure that allows the motor oil lubricant to thermally expand and contract. The pressure equalizer may be a bellows, a bladder or a labyrinth arrangement. Alternatively, a battery of mechanical seals can be used in the seal section 26.

Figure 9:
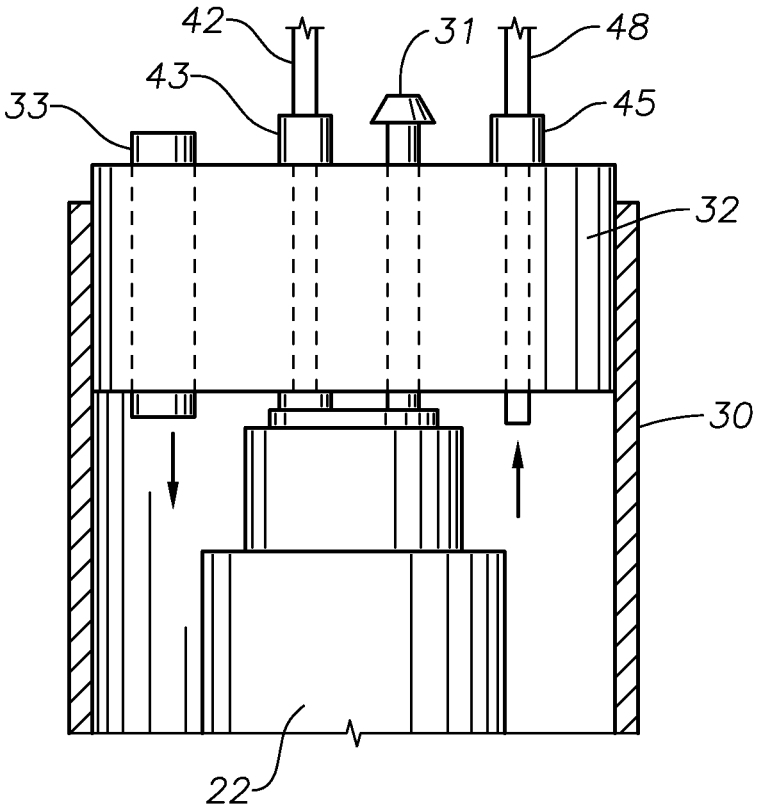
FIGS. 9 and 10 show a typical motor electrical connector and line connector arrangement, in accordance with an embodiment of the invention.
Figure 10:
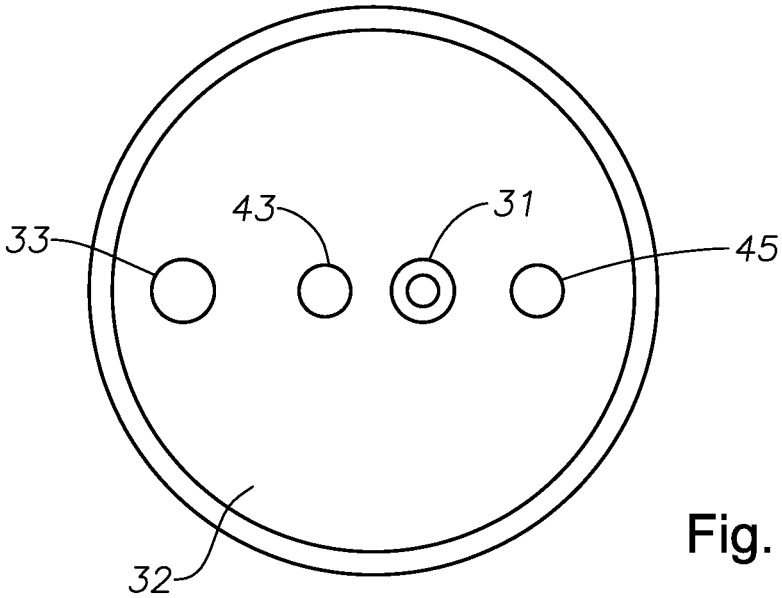

A capsule 30 houses the ESP 20 and has a cap or barrier 32 at one end and a discharge port 36 at the other end. Capsule 30 in this example is located on the sea floor and is horizontal or inclined on a skid 60 (FIG. 3). Capsule 30 may be part of a flowline jumper. The cap 32 can have various types of ports and connections depending on the configuration of the ESP within the capsule 30. In this example, the motor 22 and pump 24 are in the inverted position such that the base of the motor 22 faces the end of the capsule 30 with the cap 32. A standard subsea connector 31 that passes through the cap 32 can thus be used to connect with the base of the motor 22 as shown in FIGS. 9 and 10. Alternatively, three independent phase connectors could be utilized to provide power to the motor. A power umbilical (not shown) can then provide electrical power to the motor 22 via the subsea connector 31.

In this example, a port 33 passes through the cap 32 to allow production fluid to flow into the capsule 30. Port 33 can connect to a flow line coming directly from a well or from other subsea equipment. The fluid is discharged by the pump 24 through port 36. The discharge end of the pump 24 has a seal assembly 34 that seals the discharge end from the capsule 30. In this example, port 36 can connect to a production flow line or to a production riser that can move production fluid to, for example, a floating production storage and offloading unit, a tension leg platform, a fixed platform, or a land facility. A connection can also be made to other subsea equipment, such as a manifold, prior to routing production fluid to the surface.

During operation of the ESP 20, the temperature of the motor oil inside the motor 22 and circulating through the seal section 26 rises, causing the oil to expand. Due to expansion, the oil could damage the motor and seal section, resulting in less oil for protecting the motor, contamination of the motor, and possible contamination of other parts of the ESP 20. Further, a leak caused by the expanded oil can result in formation fluid contaminating the motor oil, which is not designed to maintain the differential pressure. Contraction of the oil as it cools when the ESP 20 is not in operation is also a problem because a vacuum can form within the motor 22 and seal section 26 that can result in failure. Compensating for the expansion and contraction of motor oil due to thermal variations can thus prevent these problems.

To address these problems, seal section 26 may have an expansion chamber (not shown) that allows the motor oil to expand as it heats up during operation of the ESP and equalizes the pressure of oil in the motor 22 with the hydrostatic pressure of the formation fluid. The terms "formation fluid" and "production fluid" are used interchangeably throughout. However, providing an expansion chamber within the seal section 26 significantly adds to the length of the ESP 20, which can impact assembly and handling of the ESP at the rig or installation vessel, and during running operations or subsea hardware installations. In addition, the reliability of seal section 26 and thus that of the ESP 20 is compromised if the internal expansion chamber fails. Typically, the seal section 26 fails because it exceeds its oil expansion capacity. The expansion chamber within the capsule has a maximum oil expansion capacity limited by the space available within the capsule. An expansion chamber on the seabed, however, can be designed for larger oil expansion capacity because there are no space limitations. Thus, by locating an expansion chamber 50 on the seabed externally to the capsule 30, or on a skid that supports capsule 30, the length of the ESP 20 could advantageously be reduced and the reliability of the ESP 20 could advantageously be increased.

Continuing to refer to FIG. 1, an oil line 42 passes through a connector 43 that passes through the cap 32 to allow the oil line 42 to communicate with the base of the motor 22. The oil line 42 allows hot motor oil from the base of the motor 22 to expand out into a bellows 54 inside the expansion chamber 50, which defines a first chamber. The bellows 54 can be made out of metal or rubber that can flex and tolerate temperature variations. Alternatively, a bladder or piston chamber, can be used instead of bellows. A capsule line 48 passes through a connector 45 that passes through the cap 32 to allow the capsule line 48 to communicate with the interior of the capsule 30 exposed to the formation fluid. The capsule line 48 allows formation fluid in the capsule 30 to travel up to a second chamber within the expansion chamber 50 defined by the expansion chamber housing 52 and the external surface of the bellows 54.

Housing 52 is sealed from hydrostatic pressure. Prior to deployment of the ESP 20 and the expansion chamber 50, they are prefilled with oil. The bellows 54 section has a check valve 49 with a preset pressure setting that allows oil to flow from the bellows 54 to the second chamber of the expansion chamber 50. The check valve 49 will provide communication to the motor oil fluid to the external part of the bellows 54 in case the maximum oil expansion is exceeded. The check valve 49 prevents formation fluid outside the bellows 54 to communicate with the internal portion of the bellows 54. This overexpansion of oil is normal in the first start up of the system, until operational stability is achieved. The oil inside the bellows 54 does not communicate with the formation fluid held in the expansion chamber 50 although the formation fluid can communicate with oil external to the bellows 54. Neither the formation fluid or oil communicate with seawater.

During operation, the hot oil inside causes the bellows 54 to expand while the formation fluid in the expansion chamber 50 simultaneously exerts external pressure on the bellows 54, thereby equalizing the pressure of oil in the motor 22 with the pressure of the formation fluid in the capsule 30 surrounding ESP 20. Oil from bellows 54 flows back through oil line 42 into motor 22. Further, when the ESP 20 is shut down, the motor oil cools and contracts. Without a provision for contraction, the contraction can create a vacuum within the ESP system that can lead to failure. Motor oil leaks due to oil expansion or contraction can thus be minimized and the motor 22 can thus be protected to operate longer and more reliably while significantly reducing the length of the ESP 20 system.

Figure 2:
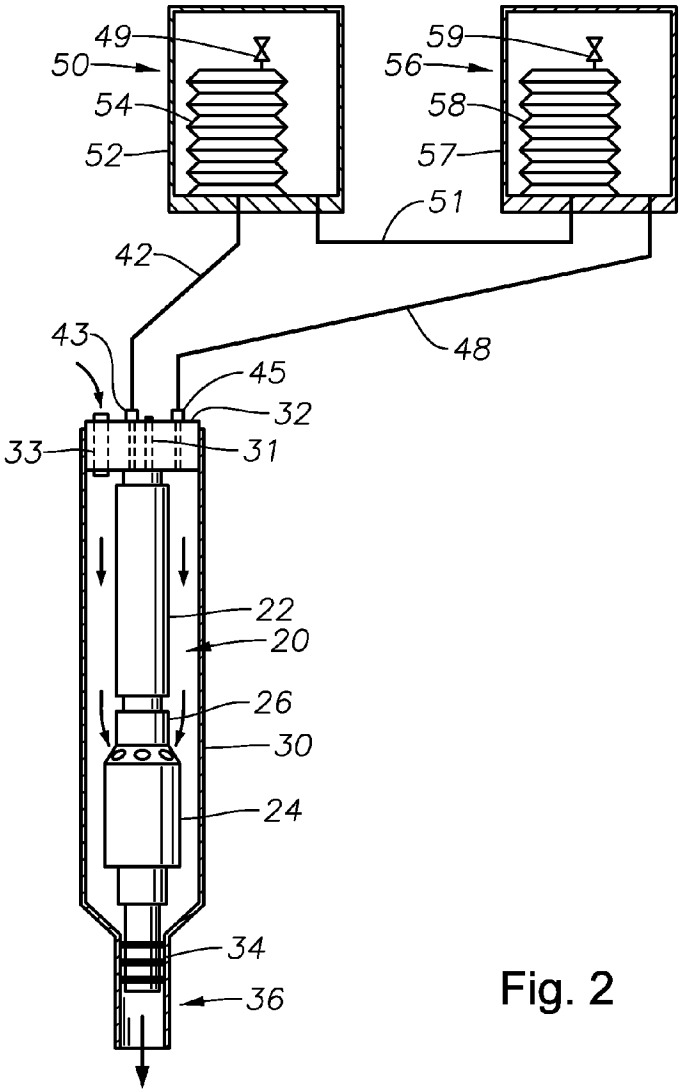
FIG. 2 is a sectional view of an alternative embodiment of the embodiment of FIG. 1.

Referring to FIG. 2, an alternative embodiment is illustrated that is similar to the embodiment shown in FIG. 1. However, in this embodiment, an additional expansion chamber 56 is shown coupled in series with the primary expansion chamber 50. The primary function of this embodiment is to provide an additional expansion chamber for redundancy proposes. The additional expansion chamber 56 can also provide additional expansion and contraction capability to the subsea system. As in the embodiment of FIG. 1, the oil line 42 allows hot motor oil from the base of the motor 22 to expand out into a bellows 54 inside the expansion chamber 50. However, capsule line 48 connects to the additional expansion chamber 56 outside of bellows 58 to allow formation fluid in the capsule 30 to travel up to a second chamber within expansion chamber 56 defined by the expansion chamber housing 57 and the external surface of the bellows 58. The interior of bellows 58 is connected by a line 51 to the exterior of bellows 54. As in the embodiment of FIG. 1, the bellows 54, 58 of both expansion chambers 50, 56 have check valves 49, 59 that allow oil to flow from one chamber to the next during prefilling. Thus, the oil inside bellows 54, 58 does not communicate with the formation fluid held in the additional expansion chamber 56 although the formation fluid can communicate with oil external to the bellows 58 in the additional expansion chamber 56. The capsule line 48 passes through a connector 45 that passes through the cap 32 to allow the capsule line 48 to communicate with the interior of the capsule 30 exposed to the formation fluid. The coupling line 51 connects the second chamber within the primary expansion chamber 50, which contains oil, and is defined by the expansion chamber housing 52 and the external surface of the bellows 54, to the interior of bellows 58 of the additional expansion chamber 56, which is also filled with oil. The use of multiple expansion chambers as in this example can further increase reliability by including redundancy. If one expansion chamber fails or leaks, the second expansion chamber can protect the subsea system. As in the embodiment of FIG. 1, the ESP system of this embodiment may be horizontally mounted or inclined on a skid 60 (FIG. 3), or vertically mounted with a caisson 100 (FIG. 4) in the seafloor, as explained below.

In the embodiment shown in FIG. 4, the capsule 30 and the ESP 20 within can be housed in a caisson 100. The caisson 100 can be partially or completely submerged in the seabed and can be several hundred feet deep. The connections and ESP 20 arrangement are identical in this embodiment to those shown in the embodiment of FIG. 1. However, the pump 24 discharges production fluid from the capsule 30 through outlet 36 and into the caisson 100 instead of a production flow line. An outlet port 104 on the caisson 100 connects to a production fluid riser or flow line. The caisson 100 can be used to separate gas in the production fluid to thereby increase pumping efficiency. The expansion chamber 50 would be located proximate and external the caisson 100 to allow for expansion of the motor oil. Alternatively, multiple expansion chambers could be utilized as in the embodiment of FIG. 2. Also, in another alternate, the production fluid could flow into the upper end of caisson 100 down around capsule 30. The fluid flows up capsule 30 and is pumped out cap 33.

Figure 5:
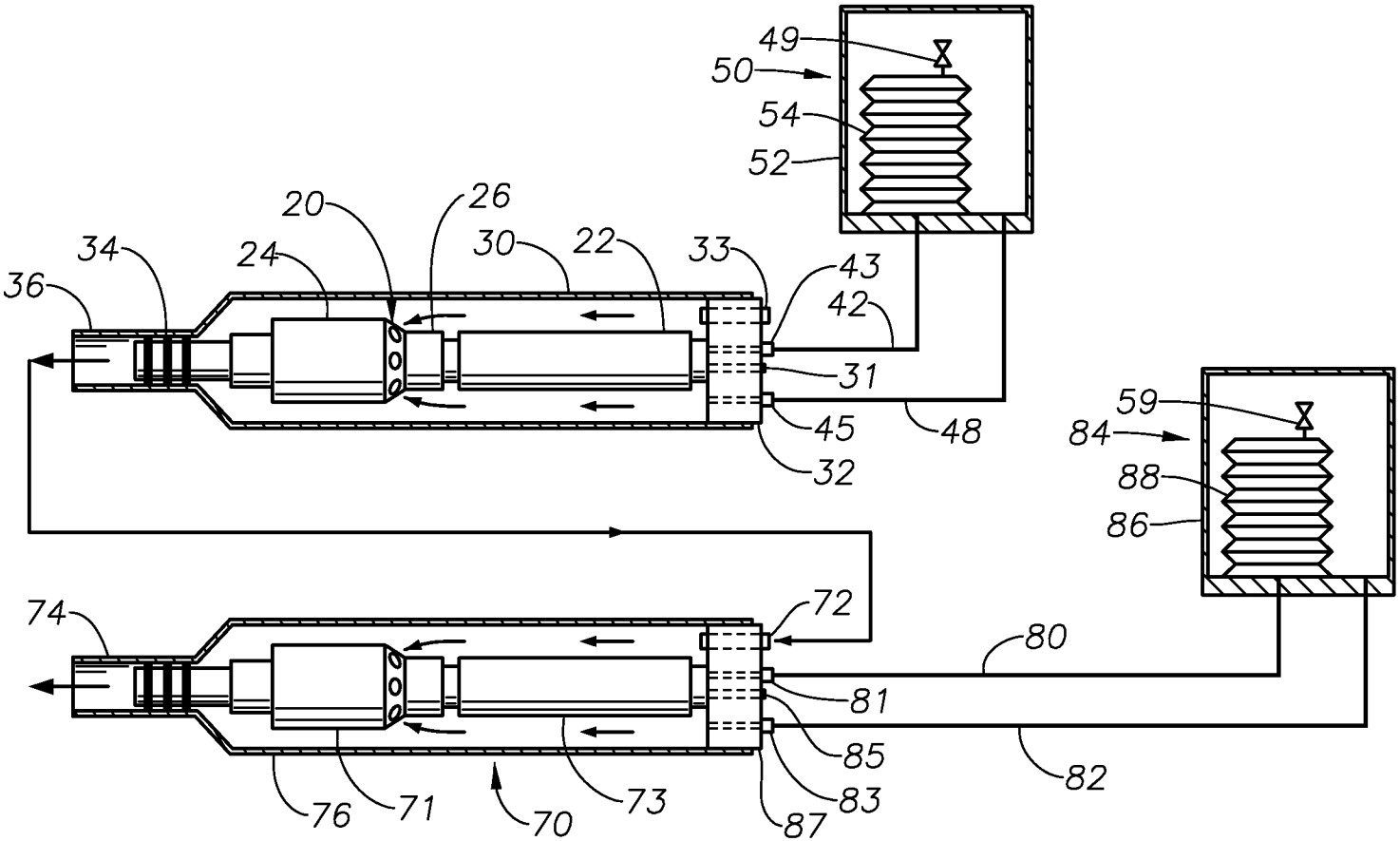
FIG. 5 is a sectional view of multiple electrical submersible pumps, each with expansion chambers, in accordance with an embodiment of the invention.

Referring to FIG. 5, an alternative embodiment is illustrated that is similar to the embodiment shown in FIG. 1. However, in this embodiment, multiple ESP systems, 20, 70 are shown connected in series, each with its own expansion chamber 50, 84. A primary ESP 20 within a capsule 30 is shown connected in series to ESP 70 within a capsule 76 to provide additional pressure boosting capacity. The discharge outlet 36 of the primary ESP 20 connects to the inlet port 72 of the secondary ESP 70. A pump 71 then discharges production fluid through a discharge outlet 74 in the secondary ESP 70. The discharge outlet 74 can connect to a production flow line or riser.

Continuing to refer to FIG. 5, the arrangement of the secondary ESP 70 is identical to that of the primary ESP 20. An oil line 80 passes through a connector 81 that passes through a cap 87 to allow the oil line 80 to communicate with the base of the motor 73. The oil line 80 allows hot motor oil from the base of the motor 73 to expand out into a bellows 88 inside the expansion chamber 84. A capsule line 82 passes through a connector 83 that passes through the cap 87 to allow the capsule line 82 to communicate with the interior of the capsule 76 exposed to the formation fluid. The capsule line 82 allows formation fluid in the capsule 76 to travel up to a second chamber within the expansion chamber 84 defined by the expansion chamber housing 86 and the external surface of the bellows 88. Both the primary ESP 20 and the secondary ESP 70 have standard subsea connectors 31, 85 that pass through their respective caps 32, 87 to connect with the base of the motors 22, 73. The subsea connectors 31, 85 allow a power umbilical (not shown) to provide electrical power to the motors 22, 73 via the subsea connectors 31, 85. Each of the ESP systems can be electrically connected in parallel by running separate umbilicals from a main power umbilical (not shown).

Figure 6:
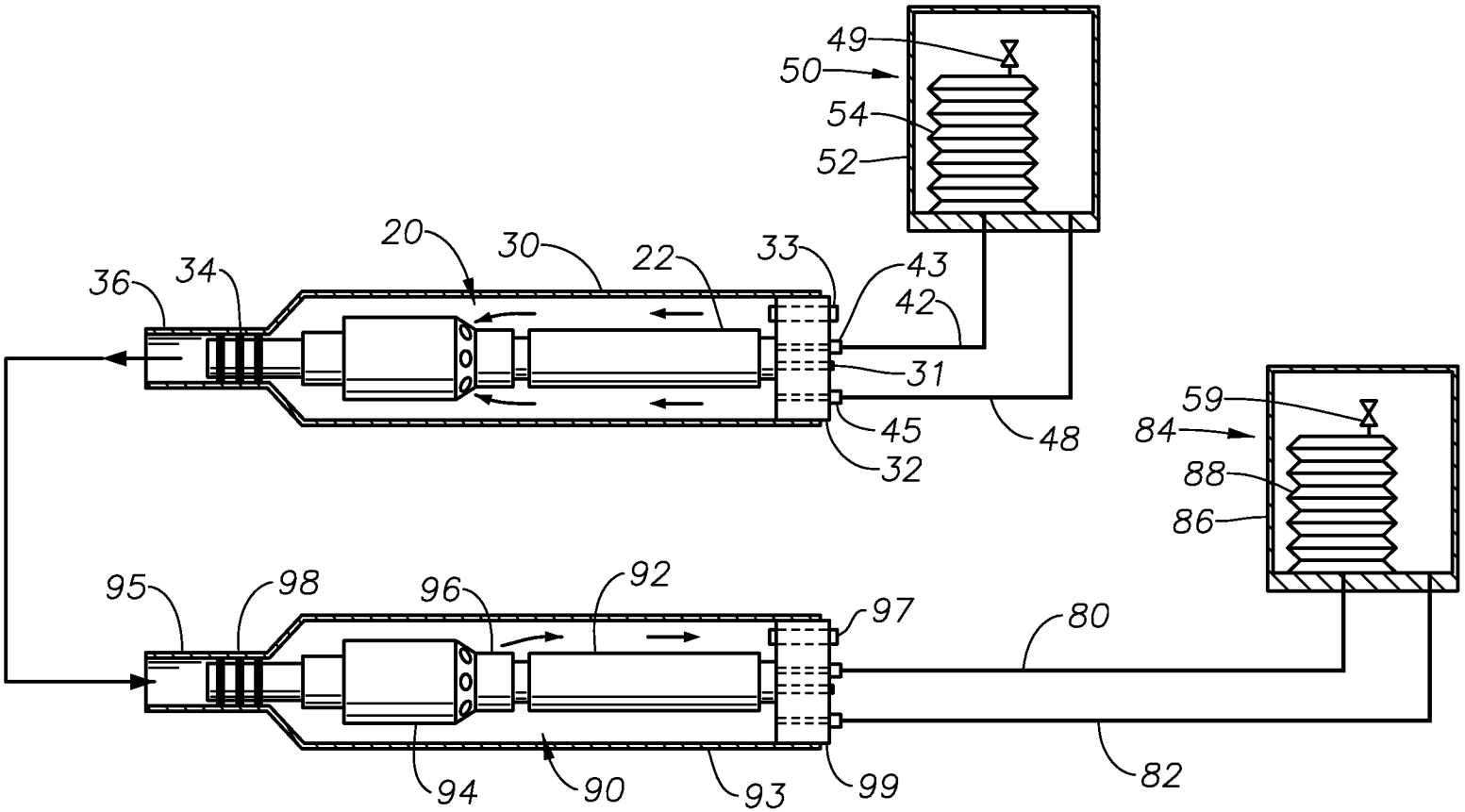
FIG. 6 is a sectional view of an alternative embodiment of the embodiment of FIG. 5.

Alternatively, stages in the pump of the secondary ESP can be inverted, as shown in FIG. 6. The embodiment shown in FIG. 6 is identical to the embodiment shown in FIG. 5, with multiple ESPs 20, 90 and expansion chambers 50, 84. However, the secondary ESP 90 has a pump 94 with inverted stages relative to pump 71 of FIG. 5 that allow for production flow in the opposite direction. Thus, the discharge outlet 36 of the primary ESP 20 connects to the inlet port 95 of the secondary ESP 90. In a non-inverted stage arrangement, such as in FIG. 5, inlet port 95 would be the discharge outlet. The inverted stage pump 94 then discharges production fluid into the capsule 93, where the fluid flows external to the motor 92 and seal section 96 and out of the capsule 93 through a discharge outlet 97 at one end of the capsule 93. The discharge outlet 97 passes through a cap 99 that is identical to the cap 32 on the primary capsule 30. The discharge outlet 97 can further connect to a production flow line or riser. In this case the bellows 88 of the expansion chamber 84 connected to the secondary pump system 90 will be balancing the oil pressure with the discharge fluid pressure.

The serially connected ESP systems in the embodiments shown in FIGS. 5 and 6 can be mounted inclined or horizontally on a skid 60 as in FIG. 3 or mounted in a caisson 100 as shown in FIG. 4. Further the multiple expansion chambers can be mounted on the skid 60 (FIG. 3) or on the seabed.

Figure 7:
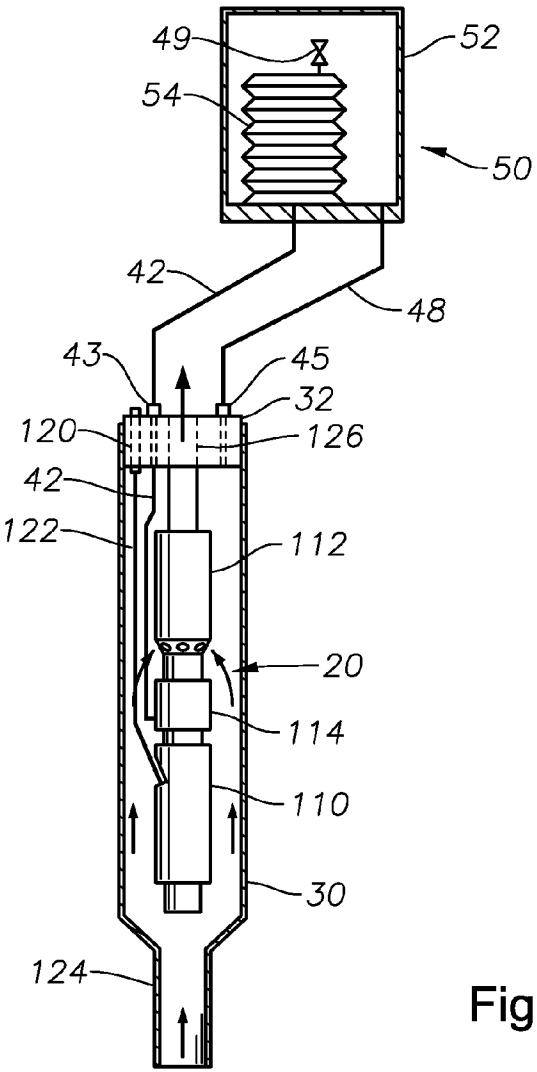
FIG. 7 is a sectional view of a standard electrical submersible pump with an expansion chamber, in accordance with an embodiment of the invention.
Figure 11:
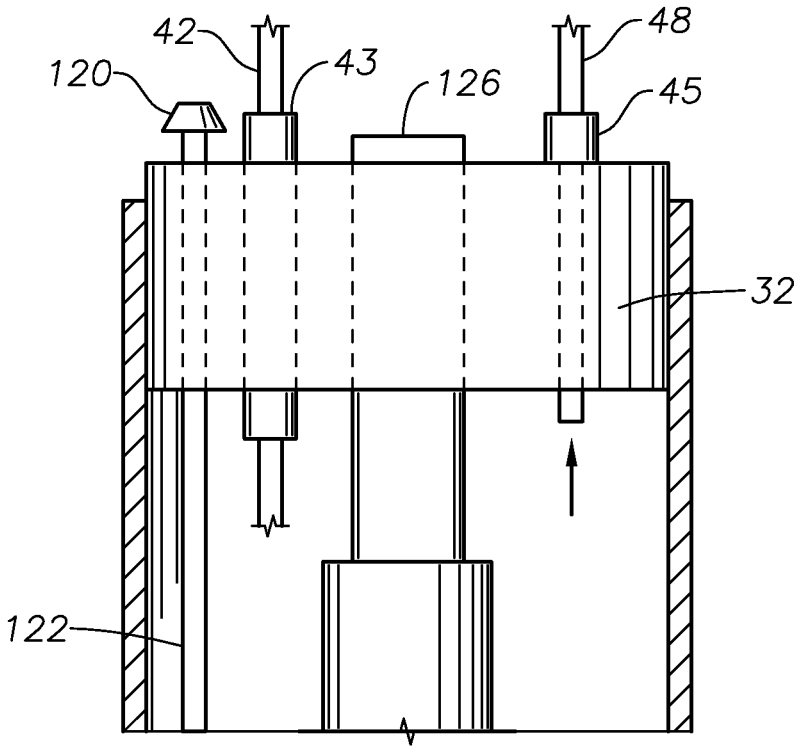
FIGS. 11 and 12 show a typical electrical penetrator and line connector arrangement, in accordance with an embodiment of the invention.
Figure 12:
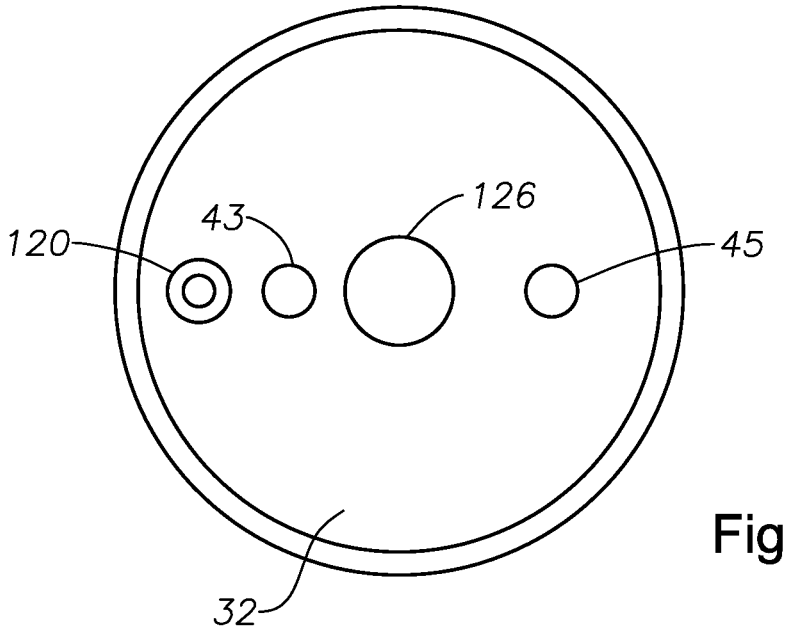

Referring to FIG. 7, an alternative embodiment is illustrated that is similar to the embodiment shown in FIG. 1. However, in this embodiment, the ESP 20 uses a standard ESP arrangement instead of an inverted arrangement. Thus, the motor 110 is located below the pump 112 and a seal section 114 is located between. Further, the production fluid will flow into the capsule 30 through a port 124 at one end of the capsule 30. Port 124 connects to a flow line carrying production fluid from a well. The pump 112 discharges the production fluid through a piece of tubing 126 that passes through the cap 32. The discharge tubing 126 can connect to a flow line or riser, as in the embodiment of FIG. 1. The base of the motor 110 in this example is at the end of the capsule 30 opposite the cap 32. A power cable 122 runs through an electrical penetrator 120 in the cap 32 (FIGS. 11 and 12) and connects to motor 110 to energize it. In this embodiment the oil line 42 connects to the bellows 54 of the expansion chamber 50 and extends down into the capsule 30 to communicate with the motor 110. As in the embodiment of FIG. 1, the capsule line 48 allows formation fluid in the capsule 30 to travel up to a second chamber within the expansion chamber 50 defined by the expansion chamber housing 52 and the external surface of the bellows 54.

Figure 8:
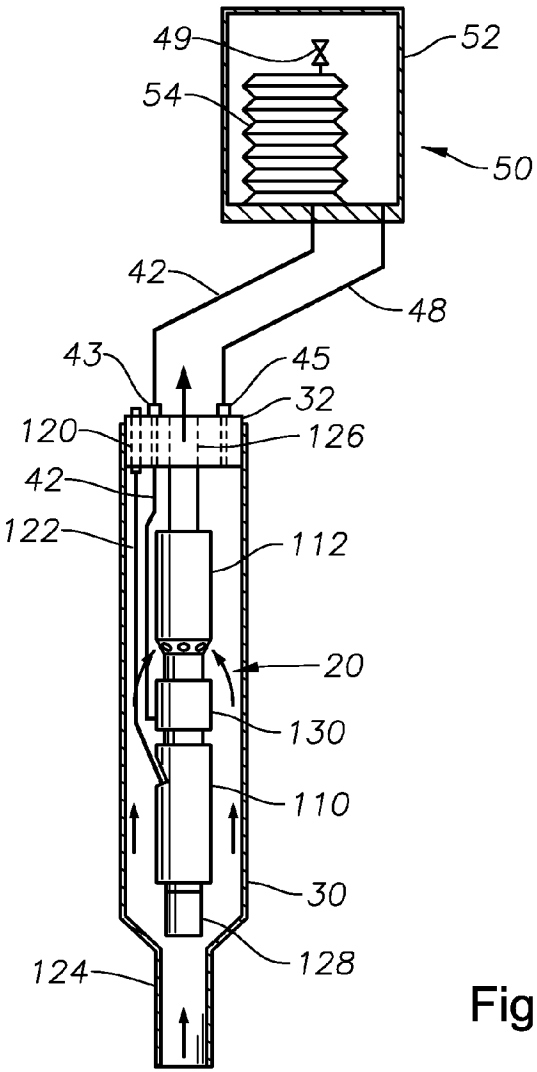
FIG. 8 is a sectional view of an alternative embodiment of the embodiment of FIG. 7.

Alternatively, the seal section 114 shown in FIG. 7 could be replaced with a battery of mechanical seals 130, as shown in FIG. 8. The embodiment shown in FIG. 8 is identical to the embodiment shown in FIG. 7, with the ESP 20 in a standard ESP arrangement and expansion chamber 50. However, replacing the seal section with the battery of mechanical seals 130 may require the addition of an internal expansion chamber 128 within that capsule 30 and at the base of the motor 110. In this embodiment then, the external expansion chamber 50 can function as a redundant expansion chamber to prevent the internal expansion chamber 128 from overexpanding.

The ESP systems in the embodiments shown in FIGS. 7 and 8 can be mounted inclined or horizontally on a skid 60 as in FIG. 3 or mounted in a caisson 100 as shown in FIG. 4.

Further the multiple expansion chambers can be mounted on the skid 60 (FIG. 3) or on the seabed.

During operation of an ESP 20, the heat generated in the motor raises the temperature of the motor oil, causing it to expand. This expansion can lead to oil migrating outside of the motor and seal section, resulting in less oil for protecting the motor and possible contamination of other parts of the ESP 20. Further, a leak caused by the expanded oil can result in formation fluid contaminating the motor oil, which is typically rated for a particular differential pressure. The conventional way of dealing with these problems requires the use of internal expansion chambers that add significant length to the ESP system, making for additional assembly and handling of the ESP at the rig and during running operations. In addition, the reliability of the expansion chamber at the seal section and thus that of the ESP 20 is compromised if the oil expansion exceeds the maximum capacity of the internal expansion chamber. Thus, by locating an expansion chamber 50 on the seabed externally to the capsule 30, or on a skid that supports capsule 30, the length of the ESP 20 could advantageously be reduced and the reliability of the ESP 20 could advantageously be increased.

While the invention has been shown in only one of its forms, it should be apparent to those skilled in the art that it is not so limited but is susceptible to various changes without departing from the scope of the invention.

What is claimed is:

1. A method for boosting pressure of well fluid flowing from a subsea well, surprising:

mounting a motor and a pump within a subsea capsule, the motor being filled with a dielectric lubricant, deploying the capsule in a subsea location, and isolating an interior of the capsule from a hydrostaic pressure of sea water in the subsea location;

providing a submerged expansion housing external of the capsule in the vicinity of a sea floor, the expansion housing having a movable barrier therein, defining a primary and a secondary chamber;

flowing well fluid into the interior of the capsule around the motor and into an intake of the pump and operating the motor and the pump to pump the well fluid from the capsule;

communicating a dielectric lubricant pressure of the dielectric lubricant in the motor to the primary chamber within the expansion housing;

communicating an intake well fluid pressure of the well fluid within the capsule before entering the intake with the secondary chamber within the expansion housing; and allowing the movable barrier to move to equalize the dielectric lubricant pressure with the well fluid intake pressure.

2. The method of clam 1, wherein the movable barrier comprises a bellows, and communicating the dielectric lubricant pressure comprises flowing the dielectric lubricant between an interior of the bellows and the motor.

3. The method of claim 2, wherein communicating the intake well fluid pressure comprises flowing the well fluid between the interior of the capsule and an exterior of the bellows.

4. The method of claim 2, wherein the primary and secondary chambers are sealed from the hydrostatic pressure of the sea water.

5. The method of claim 1, wherein the capsule is mounted on a skid and deployed on a sea floor.

6. The method of claim 1, further comprising;

providing a second expansion housing having a movable barrier, therein, defining a primary chamber and a secondary chamber; wherein communicating the intake well fluid pressure to the secondary chamber of said first mentioned expansion housing comprises communicating the well fluid in the interior of the capsule to the secondary chamber of the second expansion housing;

filling the secondary chamber of said first mentioned expansion housing with dielectric lubricant and filing the primary chamber of the second expansion housing with dielectric lubricant; and communicating the dielectric lubricant in the secondary chamber of the first expansion housing with the dielectric lubricant in the primary chamber of the secondary expansion housing.

7. The method of claim 1. wherein the capsule is located within a caisson extending into the sea floor and the expansion housing is located on the sea floor.

8. The method of claim 1, wherein the motor is immersed in the well fluid at the intake well fluid pressure.

9. A subsea eiectrical submersible booster pumping system, comprising:

a capsule adapted to be placed subsea, the capsule having an inlet leading to an interior of the capsule for receiving well fluid and an outlet, the capsule being sealed to isolate hydrostatic pressure of sea water exterior of the capsule from the interior of the capsule;

a centrifugal pump within the capsule, and having an intake within the interior of the capsule for drawing well fluid from the interior of the capsule into the pump and a discharge connected to the outlet of the capsule to discharge fluid from the capsule;

an electrical motor cooperatively coupled to the centrifugal pump and located within the interior of the capsule for immersion in the well fluid flowing to the intake of the pump, the motor being filled with a dieiectric lubricant;

at least one expansion housing exterior of the capsule, the expansion housing having a movable barrier therein, defining a primary and a secondary chamber;

a dielectric lubricant line in communication with an interior of the motor and connected to the primary chamber of the expansion housing, the dielectric lubricant line having a passage for communicating the dielectric lubricant between the motor and the primary chamber; and a well fluid line in communication with the interior of the capsule exterior of the motor, the well fluid line having a passage that communicates well fluid pressure at the intake of the pump to the secondary chamber of the expansion chamber so as to equalize a pressure of the dielectric lubricant in the motor with the well fluid pressure at the intake of the pump.

10. The system of claim 9, wherein the passage in the well fluid line communicates the well fluid to the secondary chamber.

11. The system of claim 9, wherein the movable barrier comprises a bellows that can expand and contract as the dielectric lubricant expands and contracts.

12. The system of claim 9, wherein the expansion housing is sealed so as to prevent hydrostatic pressure of sea water from acting on the primary and secondary chambers.

13. The system of claim 9, wherein the capsule is mounted on a skid adapted to be located on the sea floor.

14. The system of claim 9, wherein the passage of the well fluid line leads to the secondary chamber of the expansion housing to communicate well fluid to the secondary chamber.

15. The system of claim 9, wherein;

said at least one expansion housing further comprises a second expansion housing having a movable barrier, defining a primary chamber and a secondary chamber therein;

the well fluid line leads to the secondary chamber of the second expansion chamber; and the secondary chamber of the first mentioned expansion housing and the primary chamber of second expansion housing are filled with a liquid and connected to each other with a coupling line.

16. The system of claim 15, wherein the liquid in the primary chamber of the first mentioned expansion housing, the coupling line, and the primary chamber of the second expansion housing is dielectric lubricant.

17. the system of claim 9, wherein the dielectric lubricant line and the well fluid line pass through a cap located at one end of the capsule.

18. The system of claim 9, wherein the capsule is adopted to be located within a caisson extending into the seabed.

19. A subsea booster pump system, comprising:

a subsea capsule having a well fluid inlet and a well fluid outlet, the capsule being sealed so as to isolate an interior of the capsule from hydrostatic pressure of sea water;

a centrifugal pump and electric motor located in the capsule, the pump having an intake in fluid communication with the interior of the capsule, the pump intake being positioned so that well fluid flowing into the well fluid inlet flows over the motor to the pump intake, the pump having a discharge coupled to the outlet of the capsule to discharge the well fluid out the outlet;

an expansion housing located subsea exterior of the capsule, the expansion chamber having a movable barrier, defining a primary chamber and a secondary chamber in the expansion housing;

an inlet dielectric fluid line connected between the motor and the primary chamber of the expansion housing to communicate dielectric lubricant from the motor to one side of the movable barrier; and an inlet well fluid line connected between the interior of the capsule and the secondary chamber of the expansion housing to communicate well fluid to the other side of the movable barrier at a pressure equal to pressure of the well fluid at the pump intake.

* * * * *